US012697557B2

(12) United States Patent
Kamiyama

(10) Patent No.: US 12,697,557 B2
(45) Date of Patent: Aug. 4, 2026

(54) TOY FOR FIGURE PLAY

(71) Applicant: EPOCH COMPANY, LTD., Tokyo (JP)

(72) Inventor: Kei Kamiyama, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 171 days.

(21) Appl. No.: 18/414,021

(22) Filed: Jan. 16, 2024

(65) Prior Publication Data

US 2024/0238686 A1 Jul. 18, 2024

(30) Foreign Application Priority Data

Jan. 17, 2023 (JP) ..... 2023-005141

(51) Int. Cl.
*A63H 3/52* (2022.01)

(52) U.S. Cl.
CPC ..... *A63H 3/52* (2013.01)

(58) Field of Classification Search
CPC ..... A63H 3/52
USPC ..... 446/236–395
See application file for complete search history.

(56) References Cited

U.S. PATENT DOCUMENTS 1,148,540 A * 8/1915 Sancier ..... A63H 3/12 446/376
1,353,728 A * 9/1920 Dence ..... A47B 13/081 108/62
1,766,008 A * 6/1930 Wilcox ..... A63H 33/22 446/321
3,600,847 A * 8/1971 Lakin ..... A63H 23/04 446/457
3,713,652 A * 1/1973 Rakestraw ..... A63G 31/02 446/482
4,026,066 A * 5/1977 Reiner ..... A63H 33/22 446/236
4,161,081 A * 7/1979 Katzman ..... A63H 3/52 446/314
4,165,579 A * 8/1979 Chase ..... A63H 3/52 446/73
4,319,424 A * 3/1982 Goldfarb ..... A63H 3/52 446/268
4,381,620 A * 5/1983 Panzarella ..... A63H 33/00 446/236

(Continued)

FOREIGN PATENT DOCUMENTS

JP S61-180097 U 11/1986

*Primary Examiner* — Michael D Dennis
*Assistant Examiner* — Matthew B Stanczak
(74) *Attorney, Agent, or Firm* — Faegre Drinker Biddle & Reath LLP

(57) ABSTRACT

A toy for figure play includes: a base member, a spherical concave portion, a rotary plate, and a storage box, the spherical concave portion has a circular opening and a concave hemispherical surface corresponding to a radius of the circular opening. The spherical concave portion is provided on the base member. The rotary plate is rotatably provided in the circular opening of the spherical concave portion. The rotary plate is formed in a circular plate shape with a diameter substantially the same as an inner diameter of the circular opening. The a storage box is provided on a first surface of the rotary plate, and has a height equal to or less than a radius of the circular opening. The storage box includes an lid portion configured to open and close.

4 Claims, 6 Drawing Sheets

(56) References Cited

U.S. PATENT DOCUMENTS

| | | | | | |
|---|---|---|---|---|---|
| 4,568,304 | A * | 2/1986 | Santa Maria | A63H 3/12 | 446/330 |
| 5,041,048 | A * | 8/1991 | Lehmann | A63F 9/00 | 273/281 |
| 5,160,288 | A * | 11/1992 | Seda | A63H 33/30 | 446/236 |
| 5,417,606 | A * | 5/1995 | Kimura | A63H 3/12 | 446/330 |
| 5,971,833 | A * | 10/1999 | Rasmussen | A63H 3/52 | 446/478 |
| 2006/0014472 | A1* | 1/2006 | Spielberger | A63H 3/52 | 446/477 |
| 2010/0075573 | A1* | 3/2010 | Dubois | A63H 3/52 | 446/476 |
| 2014/0378026 | A1* | 12/2014 | Foster | B29C 43/021 | 425/62 |
| 2023/0139900 | A1* | 5/2023 | Kamiyama | A63H 3/50 | 446/268 |
| 2024/0139636 | A1* | 5/2024 | Kamiyama | A63H 3/52 | |
| 2024/0149182 | A1* | 5/2024 | Kamiyama | B62K 27/003 | |
| 2024/0238684 | A1* | 7/2024 | Kamiyama | A63H 33/003 | |
| 2024/0238685 | A1* | 7/2024 | Nakanishi | A63H 3/52 | |
| 2024/0238686 | A1* | 7/2024 | Kamiyama | A63H 3/52 | |
| 2025/0135367 | A1* | 5/2025 | Susuki | A63H 33/30 | |
| 2025/0144534 | A1* | 5/2025 | Kamiyama | A63H 3/52 | |
| 2025/0144535 | A1* | 5/2025 | Kamiyama | A63H 3/52 | |

* cited by examiner

TOY FOR FIGURE PLAY

CROSS-REFERENCE TO RELATED APPLICATIONS

This application is based on and claims priority under 35 USC 119 from Japanese Patent Application No. 2023-005141 filed on Jan. 17, 2023, the contents of which are incorporated herein by reference.

TECHNICAL FIELD

The present disclosure relates to a toy for figure play that can be played with a figure.

BACKGROUND ART

In the related art, a toy is disclosed that includes a rotating mechanism that allows, by including a rotary plate, a play by switching between one side (the first surface side) and the other side (the second surface side) of the rotary plate. For example, JPS61-180097U discloses a toy including a rotating mechanism capable of causing a lighting lamp provided on a roof of an automobile toy to be retractable.

SUMMARY OF INVENTION

In the toy for figure play, by providing the rotary plate, for example, a treasure box is retractable, so that the toy for figure play can be played in the same way as a treasure hunt. However, a child who is a user may drop a small object such as a belonging or a treasure held by the figure into a housing that supports the rotary plate. In the rotating mechanism of the rotary plate in the related art, when a small object falls into the housing, it may be difficult to take out the small object.

An object of the present disclosure is to provide a toy for figure play including a rotating mechanism that reduces falling of a small object into a housing.

In an aspect of the present disclosure, a toy for figure play includes: a base member; a spherical concave portion having a circular opening and a concave hemispherical surface corresponding to a radius of the circular opening, the spherical concave portion being provided on the base member; a rotary plate rotatably provided in the circular opening of the spherical concave portion, the rotary plate being formed in a circular plate shape with a diameter substantially the same as an inner diameter of the circular opening; and a storage box provided on a first surface of the rotary plate, the storage box having a height equal to or less than a radius of the circular opening, the storage box including an lid portion configured to open and close.

According to an aspect of the present discourse, it is possible to provide a toy for figure play including a rotating mechanism that reduces falling of a small object into a housing.

BRIEF DESCRIPTION OF DRAWINGS

The present disclosure will be described in detail based on the following without being limited thereto, wherein:

FIGS. 3A and 3B are perspective views showing the state in which the treasure box-shaped portion of the treasure box portion of the toy for figure play according to the embodiment of the present disclosure appears, in which FIG. 3A shows the state in which a lid portion of the treasure box-shaped portion is closed, and FIG. 3B shows the state in which the lid portion of the treasure box-shaped portion is opened;

DESCRIPTION OF EMBODIMENTS

Figure 1:
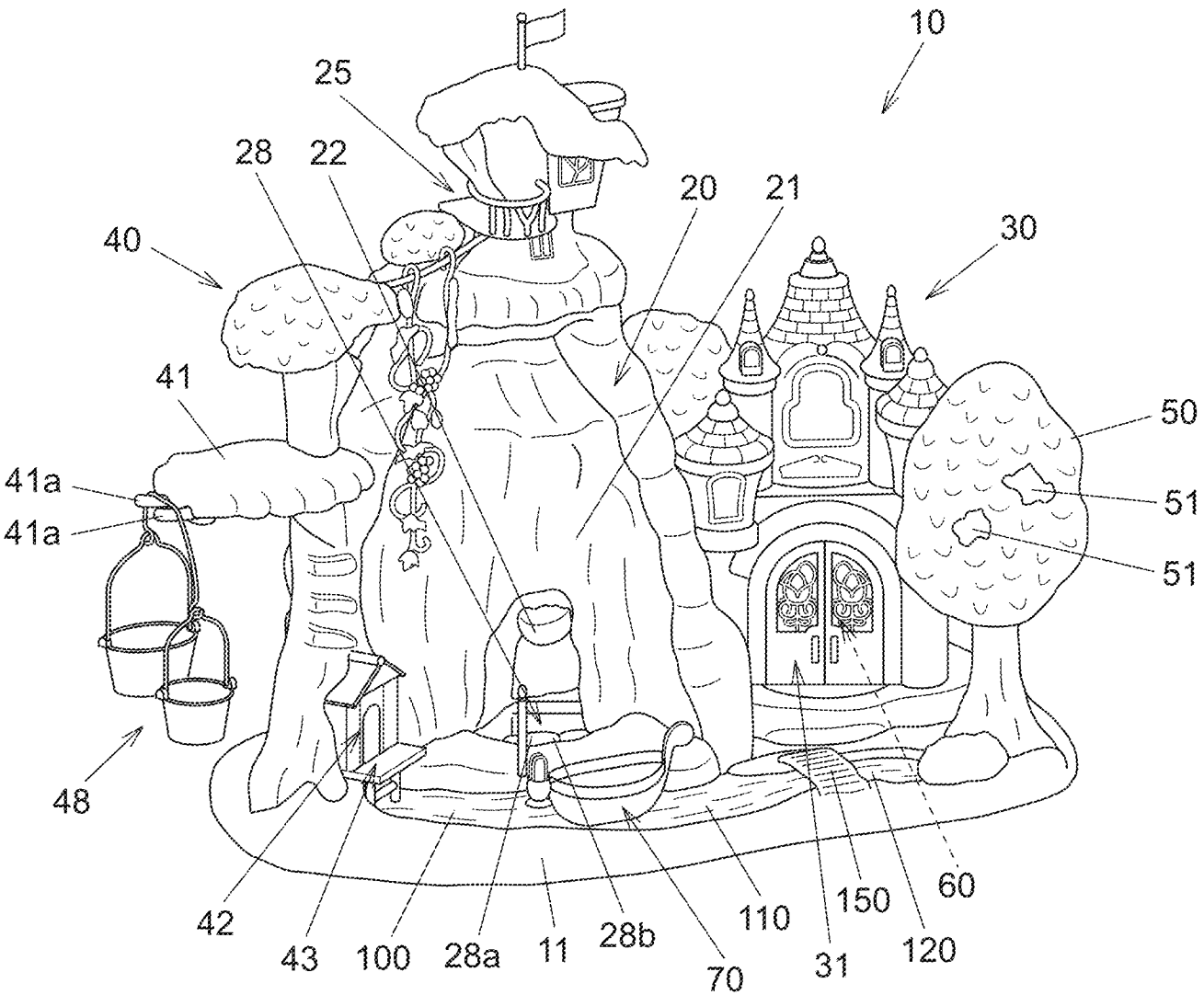
FIG. 1 is a perspective view showing a toy for figure play according to an embodiment of the present disclosure.

An embodiment of the present disclosure will be described with reference to the drawings. FIG. 1 is an overall perspective view of a toy 10 for figure play. The toy 10 for figure play includes a substantially plate-shaped base member 11. In the following description, the front side of the toy 10 for figure play is referred to as front, the back side is referred to as rear, the left side when the toy 10 for figure play is viewed from the front is referred to as left, and the right side is referred to as right.

On the front side of the base member 11, an elongated shape portion 100 is provided which is long in a left-right direction and which is formed by imitating a river with the left side being the upstream side. A waterfall-shaped portion 20 imitating a waterfall is provided on the substantially central left side of the base member 11. A castle-shaped portion 30 imitating a castle is provided on the right side of the waterfall-shaped portion 20. A left tree portion 40 imitating a tree in a forest is provided in the vicinity of the left end of the elongated shape portion 100 and on the base member 11 on the left side of the waterfall-shaped portion 20. A right tree portion 50 imitating a tree in the forest that is lower than the left tree portion 40 is provided in the vicinity of the right end of the elongated shape portion 100 and on the right front side of the castle-shaped portion 30.

The elongated shape portion 100 includes a fixing member 110 fixed to the base member 11, and a substantially flat plate-shaped detachable member 120 provided detachably from the base member 11. In the waterfall-shaped portion 20, a waterfall body 21 is connected to the fixing member 110 of the elongated shape portion 100 in a manner of imitating a state in which water falling from a waterfall flows as a river. A protruding rock 22 imitating a rock protruding from the back side of the waterfall is provided at the substantially central lower portion of the waterfall body 21. The lower side of the protruding rock 22 is opened. A waterfall-shaped portion stage 25 is provided at the upper end of the waterfall-shaped portion 20. A pond portion 28 imitating a pond is provided on the back side of the waterfall-shaped portion 20. The pond portion 28 is provided with a plurality of rocks 28*a* and a pond surface portion 28*b*.

The waterfall body 21, the elongated shape portion 100 (the fixing member 110 and the detachable member 120), and the pond surface portion 28*b* of the pond portion 28 are formed of a transparent material.

The castle-shaped portion 30 is provided with a double door 31 at the central lower portion. A treasure box portion 60 is provided on the rear side of the door 31. That is, the treasure box portion 60 is provided on the back side of the castle-shaped portion 30 corresponding to the door 31.

A stage 41 is provided on the left tree portion 40 slightly above the center in the upper-lower direction. A door portion 42 is provided at the lower end of the left tree portion 40. An elevating platform 43 is provided from the door portion 42 and protrudes toward the elongated shape portion 100. A user can play with a figure by floating a boat toy 70 imitating a boat on the elongated shape portion 100 and allowing the figure to get on and off the boat toy from this elevating platform 43.

On the stage 41 of the left tree portion 40, a basket play toy 48, which is played with a basket tied to both ends of a rope, is hung on two protrusions 41*a*.

The right tree portion 50 is formed with openings 51 at two locations. The figure can be played by, for example, showing the head through the opening 51 as if the figure climbs a tree.

Figure 2:
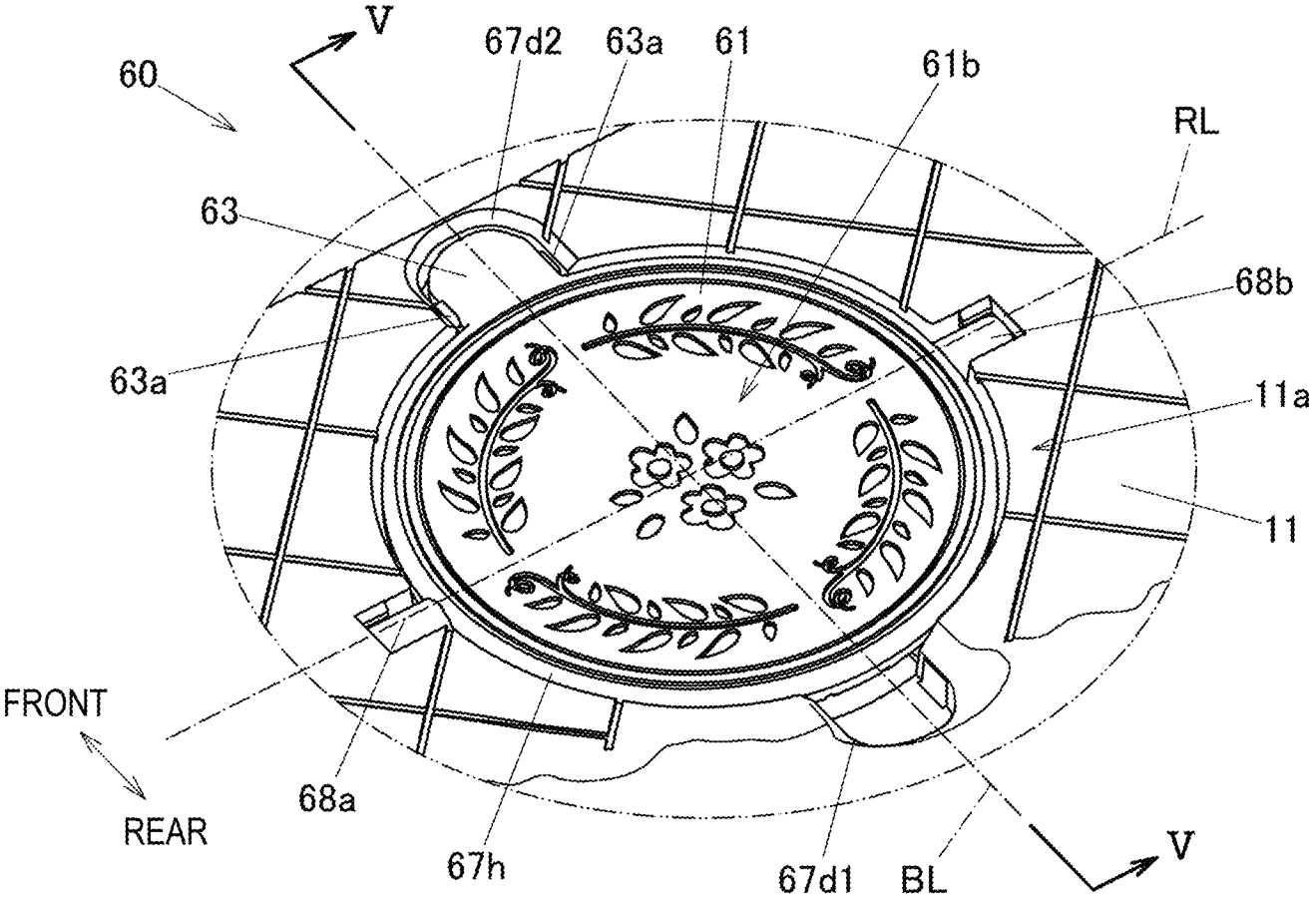
FIG. 2 is a perspective view showing the state in which a treasure box-shaped portion of a treasure box portion of the toy for figure play according to the embodiment of the present disclosure is retracted.
Figure 3A:
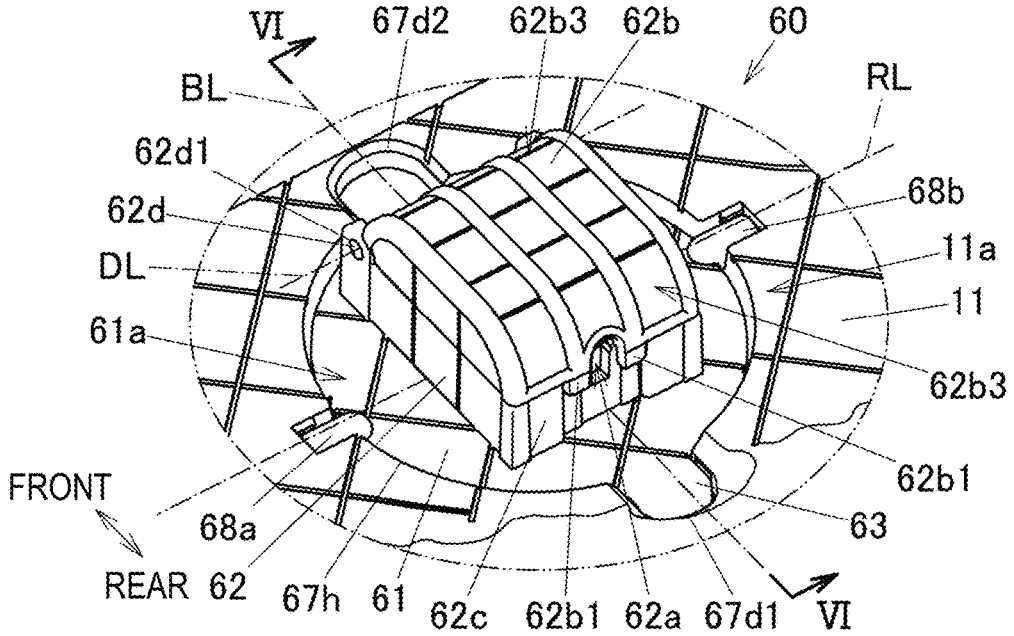
Figure 3B:
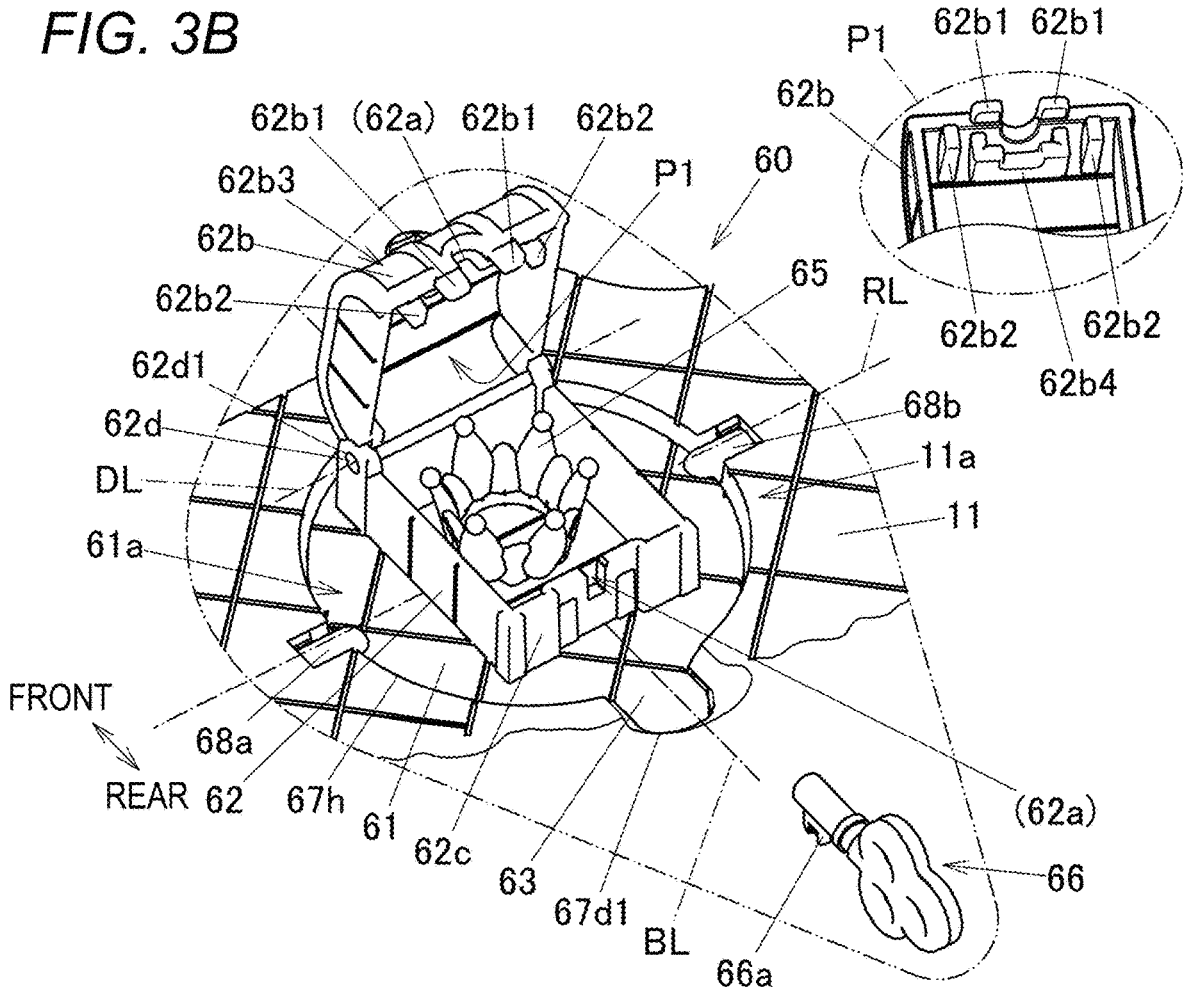

As shown in FIGS. 2, 3A, and 3B, the treasure box portion 60 is provided with a rotary plate 61. The rotary plate 61 is formed in a substantially circular plate shape, and is provided with columnar rotary shafts 68*a* and 68*b* that protrude radially outward. As shown in FIGS. 3A and 3B, a rectangular parallelepiped storage box 62 having an openable and closable lid portion 62*b* is provided on a first surface 61*a* side of the rotary plate 61. The storage box 62 is formed by imitating a treasure box with a key hole 62*a* facing rearward in the state in FIGS. 3A and 3B. The key hole 62*a* is formed across the lid portion 62*b* and a storage box body 62*c*. A crown toy 65, which is a treasure imitating a crown, is stored inside the storage box 62.

The storage box 62 includes a hinge portion 62*d* on the side opposite to the key hole 62*a* such that the direction of a rotation shaft DL is parallel to a rotary axis RL of the rotary shafts 68*a* and 68*b* of the rotary plate 61, and the lid portion 62*b* rotates around the rotation shaft DL of the hinge portion 62*d*. In the hinge portion 62*d*, two shaft holes 62*d*1 are formed on the storage box body 62*c* side, and a protruding shaft (not shown) protruding from the lid portion 62*b* is rotatably inserted into the shaft holes 62*d*1.

On both sides of the key hole 62*a* on the lid portion 62*b* side, two outer claws 62*b*1 located outside the storage box body 62*c* when the lid portion 62*b* is closed and two inner claws 62*b*2 located inside the storage box body 62*c* when the lid portion 62*b* is closed are provided. When the lid portion 62*b* is closed, the outer claw 62*b*1 and the inner claw 62*b*2 sandwich the rear side wall of the storage box body 62*c* to provide resistance, thereby reducing the risk that the lid portion 62*b* opens unexpectedly.

The storage box 62 has a key hole 62*a* but is not locked by the key 66, and the lid portion 62*b* can be manually opened and closed. Therefore, the user can play by inserting the key 66 into the key hole 62*a* and imitating the unlocking operation. Here, as shown in a boxed view seen from a PI direction in FIG. 3B, on the back side of the lid portion 62*b*, an abutting plate portion 62*b*4 formed in a substantially U shape is provided between the inner claws 62*b*2. The abutting plate portion 6264 is formed with a notch corresponding to the key hole 62*a* of the lid portion 62*b*. When the key 66 is inserted into the key hole 62*a* and the key 66 is turned, by abutting a protrusion 66*a* at the tip of the key 66 around the notch of the abutting plate portion 62*b*4, the lid portion 62*b* can be lifted and the lid portion 62*b* can be opened slightly. In this way, the user can play as if a treasure box is unlocked with the key 66.

The key 66 can be stored in a manner of being hidden in a storage portion or the like hidden by a detachably provided portion or the like of the elongated shape portion 100.

Figure 5:
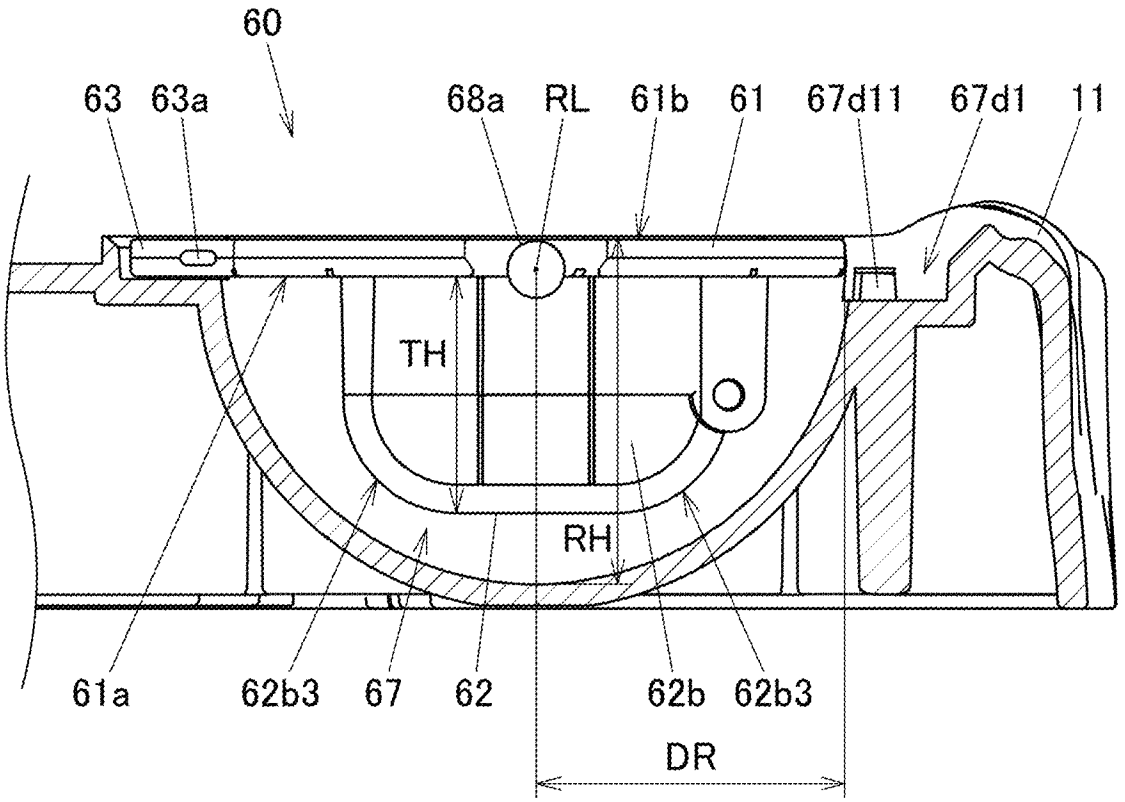
FIG. 5 is a cross-sectional view of a base member and the rotary plate of the toy for figure play according to the embodiment of the present disclosure taken along a line V-V in FIG. 2.
Figure 6:
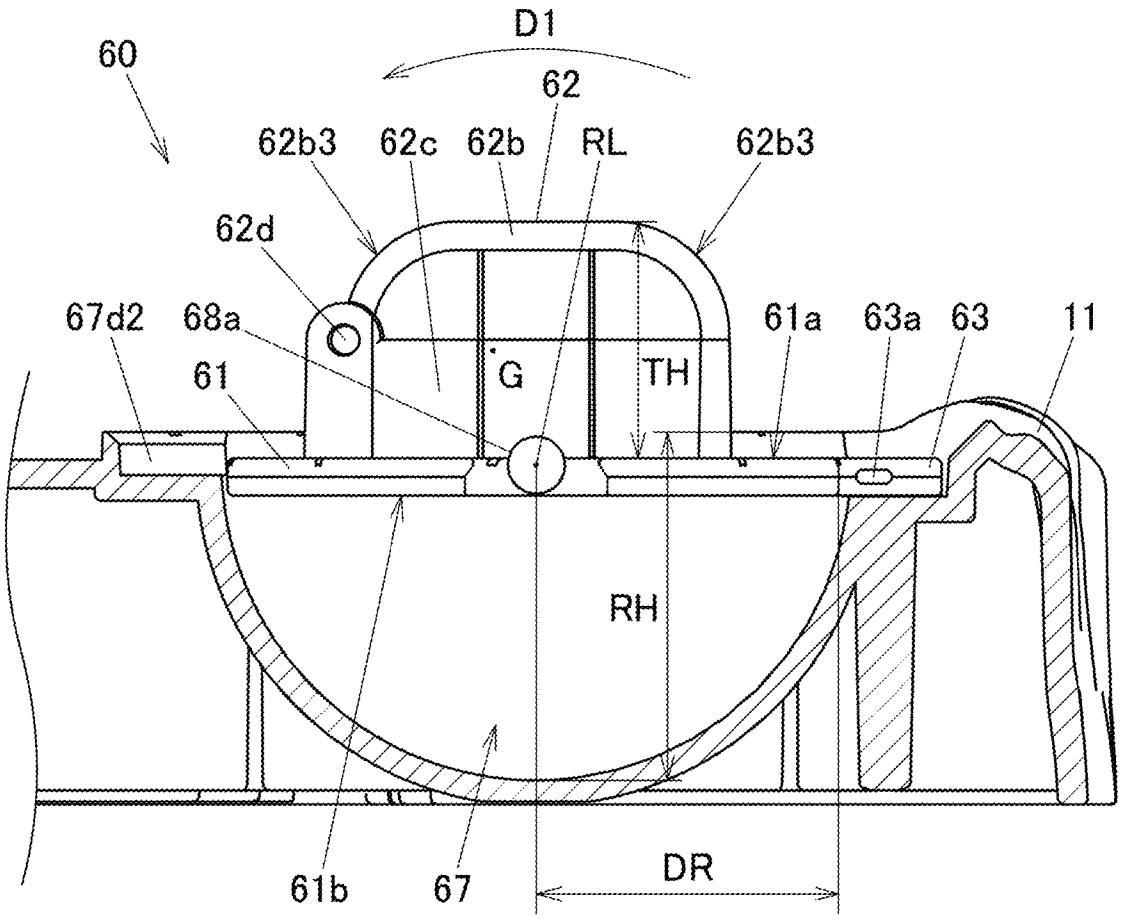
FIG. 6 is a cross-sectional view of the base member and the rotary plate of the toy for figure play according to the embodiment of the present disclosure taken along a line VI-VI in FIG. 3A.

The rotary plate 61 is provided with a restriction protrusion 63 that protrudes in a plate shape in the radially outward direction of the rotary plate 61 on an axis BL of the rotary plate 61 that is perpendicular to the rotation axis RL. The restriction protrusion 63 has a surface that is continuous with the first surface 61*a* of the rotary plate 61 and a second surface 61*b* on the side opposite to the first surface 61*a*. The restriction protrusion 63 includes a distal end portion formed in a convex arc shape. As shown in FIGS. 5 and 6, engagement protrusions 63*a* are provided on both side portions of the restriction protrusion 63.

Figure 4:
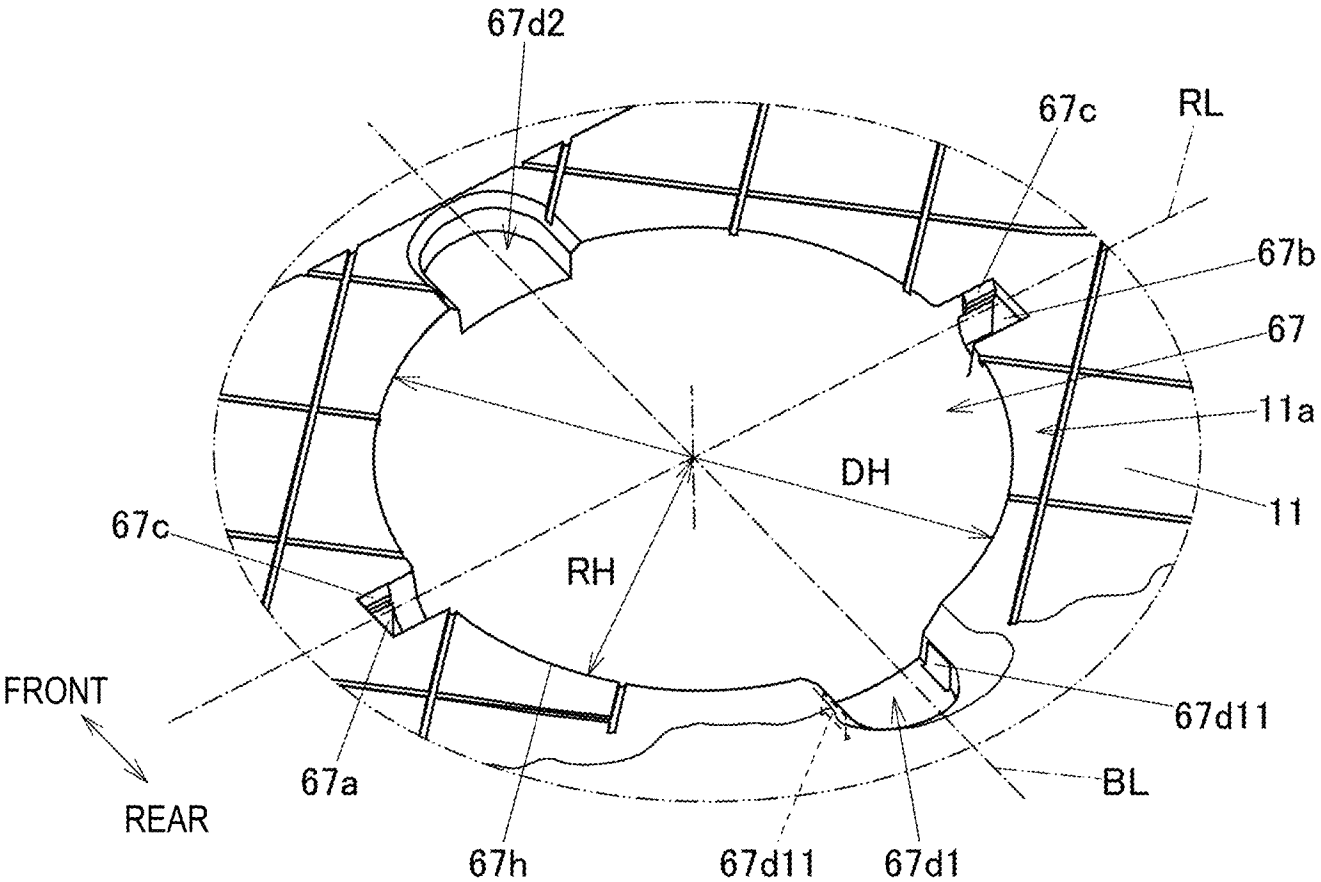
FIG. 4 is a perspective view in which a rotary plate of the treasure box portion of the toy for figure play according to the embodiment of the present disclosure is omitted.

The rotary plate 61 is provided in a circular opening 67*h* of the base member 11. As shown in FIG. 4, the opening 67*h* is an opening of a spherical concave portion 67 provided in a spherical concave shape from an upper surface 11*a* of the base member 11. The spherical concave portion 67 is a hemispherical surface corresponding to a radius RH of the opening 67*h*, that is, a hemispherical surface having the radius RH (see also FIGS. 5 and 6).

At the edge portion of the opening 67*h* of the spherical concave portion 67, bearing portions 67*a* and 67*b* that receive the rotary shafts 68*a* and 68*b* of the rotary plate 61 are provided. The bearing portions 67*a* and 67*b* include locking protrusions 67*c* facing in the bearing portions 67*a* and 67*b*. The rotary shafts 68*a* and 68*b* of the rotary plate 61 are prevented from coming off by the locking protrusions 67*c*.

In the spherical concave portion 67, a first engagement recess 67*d*1 and a second engagement recess 67*d*2 face each other at the edge portion of the opening 67*h* on the axis BL perpendicular to the rotation axis RL of the rotary plate 61. The first engagement recess 67*d*1 and the second engagement recess 67*d*2 can engage with the restriction protrusion 63 of the rotary plate 61. Engagement holes 67*d*11 are formed on both side surfaces of the first engagement recess 67*d*1.

When the restriction protrusion 63 engages with the first engagement recess 67*d*1, the engagement protrusion 63*a* of the restriction protrusion 63 of the rotary plate 61 engages with the engagement hole 67*d*11 in a manner of fitting into the engagement hole 67*d*11. Accordingly, it is possible to ensure the engagement between the restriction protrusion 63 and the first engagement recess 67*d*1 and to prevent the rotary plate 61 from rotating unexpectedly, and it is possible to obtain a click feeling when the engagement between the restriction protrusion 63 and the first engagement recess 67*d*1 is released. When the restriction protrusion 63 engages with the second engagement recess 67*d*2, the engagement protrusion 63*a* of the restriction protrusion 63 comes into sliding contact with the side wall of the second engagement recess 67*d*2, and a predetermined resistance can be obtained.

As shown in FIGS. 5 and 6, the rotary plate 61 is provided inside the opening 67*h* with a slight gap from the edge of the opening 67*h*, and a rotation axis of the rotary plate 61 extends along a diameter of the rotary plate 61. In other words, the rotary plate 61 has a diameter that is slightly smaller than the inner diameter (a diameter DH, see FIG. 4) of the opening 67*h*. Accordingly, the radius DR of the rotary plate 61 is slightly smaller than the radius RH of the spherical concave portion 67. When the rotary plate 61 rotates, the edge of the rotary plate 61 approaches the surface of the spherical concave portion 67 with a slight gap.

A height TH of the storage box 62 is equal to or less than the radius RH of the opening 67*h*. The lid portion 62*b* of the storage box 62 has a round corner in the side view when viewed from the direction of the rotation axis RL of the rotary plate 61. In other words, in the lid portion 62*b*, corner portions 6263 on the key hole 62*a* side and the hinge portion 62*d* side have a corner R shape. Since the corner portion 62*b*3 has the corner R shape, the height TH of the storage box 62 can be increased while avoiding interference with the spherical concave portion 67 when the rotary plate 61 rotates.

The rotation axis RL of the rotary plate 61 is not located at the center of the rotary plate 61 in the plate thickness direction, but is set to be closer to the first surface 61*a* than the second surface 61*b*. The outer peripheral surfaces of the rotary shafts 68*a* and 68*b* of the rotary plate 61 protrude from the first surface 61*a* on the first surface 61*a* side of the rotary plate 61 and do not protrude from the second surface 61*b* on the second surface 61*b* side of the rotary plate 61.

Therefore, in the retracted state shown in FIG. 2 in which the storage box 62 does not appear, the second surface 61*b* is a flat surface that is substantially continuous with the upper surface 11*a* (the upper surface 11*a* around the treasure box portion 60) of the base member 11. In the appearance state shown in FIGS. 3A and 3B in which the storage box 62 appears, the first surface 61*a* is at a position slightly depressed from the upper surface 11*a* (the upper surface 11*a* around the treasure box portion 60) of the base member 11.

The treasure box portion 60 serving as a rotating mechanism can cause the storage box 62 to be retractable by rotating the rotary plate 61 with the finger. Here, in the state in which the storage box 62 appears, as shown in FIGS. 3A and 3B, the restriction protrusion 63 engages with the first engagement recess 67*d*1. Accordingly, the rotary plate 61 is restricted from rotating in a direction opposite to a counterclockwise rotating direction D1 when viewed in FIG. 6. In the case in which the storage box 62 is retracted, when the rotary plate 61 is rotated in the rotating direction D1, the restriction protrusion 63 engages with the second engagement recess 67*d*2.

Here, the center of gravity G of the storage box 62 is provided on the opposite side (one side) of the rotation axis RL of the rotary plate 61 to the side where the restriction protrusion 63 is provided. Therefore, when the storage box 62 is brought into the retracted state from the appearance state, if the rotary plate 61 is rotated to a certain extent in the direction D1, the rotary plate 61 automatically rotates even if the user releases the finger, and the state in FIG. 5 can be achieved.

Here, even if a small object such as the key 66 is dropped into the spherical concave portion 67 while the rotary plate 61 is rotating, if the rotary plate 61 continues to rotate, the dropped small object can be scraped out by the rotary plate 61 and the concave spherical surface of the spherical concave portion 67 and easily taken out, and does not enter the inside of the base member 11 which is the housing. Further, even if the lid portion 62*b* opens due to vibration or the like when the storage box 62 is retracted, since the corner portion 62*b*3 of the lid portion 62*b* is formed in the corner R shape, the corner portion 62*b*3 can come into sliding contact with the spherical concave portion 67 and rotate the rotary plate 61. Further, even during the rotation of the rotary plate 61, the lid portion 62*b* is brought into sliding contact with the concave spherical surface of the spherical concave portion 67, and does not open completely. Therefore, the risk of the crown toy 65 placed in the storage box 62 falling out is reduced.

According to the embodiment of the present disclosure described above, it is possible to provide a toy for figure play with the following aspects.

A toy for figure play according to a first aspect includes: a base member; a spherical concave portion having a circular opening and a concave hemispherical surface corresponding to a radius of the circular opening, the spherical concave portion being provided on the base member; a rotary plate rotatably provided in the circular opening of the spherical concave portion, the rotary plate being formed in a circular plate shape with a diameter substantially the same as an inner diameter of the circular opening; and a storage box provided on a first surface of the rotary plate, the storage box having a height equal to or less than a radius of the opening, the storage box including an lid portion configured to open and close.

According to this configuration, even if a small object is dropped into the spherical concave portion, since the small object can be taken out by being scraped out by the rotary plate, it is possible to provide a toy for figure play including a rotating mechanism that reduces the risk of dropping of the small object into the housing. Regardless of whether the storage box contains a small object, the spherical concave portion reduces the risk that the lid of the storage box interferes with the rotation of the rotary plate. Further, the spherical concave portion reduces the risk that the lid portion of the storage box opens during the rotation of the rotary plate.

In the toy for figure play according to a second aspect, a center of gravity of the storage box is set on one side with respect to a rotation axis of the rotary plate.

According to this configuration, when the rotary plate is rotated halfway, the rotary plate can be rotated automatically even if the hand is released. Therefore, the risk that the rotary plate stops halfway can be reduced.

In the toy for figure play according to a third aspect, the rotary plate includes a restriction protrusion that protrudes radially outward on an axis perpendicular to a rotation axis of the rotary plate, and the spherical concave portion has a first engagement recess and a second engagement recess, the first engagement recess and the second engagement recess being formed at an edge portion of the circular opening on the axis perpendicular to the rotation axis of the rotary plate such that the first engagement recess and the second engagement recess face the restriction protrusion so as to engage with the restriction protrusion.

According to this configuration, it is possible to reliably maintain the position where either the first surface of the rotary plate or the second surface on the side opposite to the first surface is exposed.

In the toy for figure play according to a fourth aspect, the storage box has a rectangular parallelepiped shape, and the lid portion has a round corner in a side view when viewed in a direction of a rotation axis of the rotary plate.

According to this configuration, it is possible to smoothly rotate the rotary plate while increasing the height of the storage box.

In the toy for figure play according to a fifth aspect, a rotation axis of the rotary plate is set to be closer to the first surface of the rotary plate than a second surface of the rotary plate opposite to the first surface, and an outer periphery of a rotary shaft of the rotary plate protrudes from the first surface, and does not protrude from the second surface.

According to this configuration, in a state in which the second surface of the rotary plate is exposed, the second surface of the rotary plate and the surface around the opening can be substantially continuous surfaces.

Although the embodiment of the present disclosure has been described above, the present disclosure is not limited to the above embodiment, and various modifications can be made without departing from the gist thereof.

What is claimed is:

1. A toy for figure play comprising:

a base member;

a spherical concave portion having a circular opening and a concave hemispherical surface corresponding to a radius of the circular opening, the spherical concave portion being provided on the base member;

a rotary plate rotatably provided in the circular opening of the spherical concave portion, the rotary plate being formed in a circular plate shape with a diameter the same as an inner diameter of the circular opening, a rotation axis of the rotary plate extends along a diameter of the rotary plate; and a storage box provided on a first surface of the rotary plate, the storage box having a height equal to or less than a radius of the circular opening, the storage box comprising a lid portion configured to open and close, wherein the rotation axis of the rotary plate is set to be closer to the first surface of the rotary plate than a second surface of the rotary plate opposite to the first surface, and wherein an outer periphery of a rotary shaft of the rotary plate protrudes from the first surface, and does not protrude from the second surface.

2. The toy for figure play according to claim 1, wherein a center of gravity of the storage box is set on one side with respect to the rotation axis of the rotary plate.

3. The toy for figure play according to claim 1, wherein the rotary plate comprises a restriction protrusion that protrudes radially outward on an axis perpendicular to the rotation axis of the rotary plate, and wherein the spherical concave portion has a first engagement recess and a second engagement recess, the first engagement recess and the second engagement recess being formed at an edge portion of the circular opening on the axis perpendicular to the rotation axis of the rotary plate such that the first engagement recess and the second engagement recess face the restriction protrusion so as to engage with the restriction protrusion.

4. The toy for figure play according to claim 1, wherein the storage box has a rectangular parallelepiped shape, and wherein the lid portion has a round corner in a side view when viewed in a direction of the rotation axis of the rotary plate.

* * * * *